United States Patent [19]

Evans et al.

[11] Patent Number: 4,526,364

[45] Date of Patent: Jul. 2, 1985

[54] SHEET FEEDING MECHANISM FOR DUPLICATING MACHINE WITH DUPLEXING CAPABILITY

[75] Inventors: Robert H. Evans, Palatine; Charles H. Espersen, Hoffman Estates; John W. Tsai, Schaumburg, all of Ill.

[73] Assignee: AM International, Inc., Chicago, Ill.

[21] Appl. No.: 476,446

[22] Filed: Mar. 17, 1983

[51] Int. Cl.[3] ..... B65H 5/02

[52] U.S. Cl. ..... 271/272; 403/397; 403/399

[58] Field of Search ..... 271/272, 274, 117; 226/179, 180, 190, 194, 181; 403/397-399

[56] References Cited

U.S. PATENT DOCUMENTS 2,201,605 5/1940 Backhouse ..... 271/272

2,582,280 1/1952 Robertson ..... 226/190 X 3,476,381 11/1969 Carlson ..... 271/117

*Primary Examiner*—Richard A. Schacher

*Attorney, Agent, or Firm*—Nicholas A. Camasto; John R. Hoffman

[57] ABSTRACT

A sheet material feeding mechanism for use in a duplex duplicating machine. A pressure roller extends laterally across a sheet path for engaging the blank side of a previously imaged copy sheet. A feed roller assembly forms a nip with the pressure roller through which the sheet is fed. The feed roller assembly includes a pair of feed rollers mounted on the outside of a pair of support members for positioning the feed rollers near the marginal edges of the sheet to preclude tracking the imaged side of the sheet. The feed rollers are axially adjustable for accommodating different sheet sizes.

3 Claims, 5 Drawing Figures

SHEET FEEDING MECHANISM FOR DUPLICATING MACHINE WITH DUPLEXING CAPABILITY

BACKGROUND OF THE INVENTION

This invention relates generally to duplicating machines and, more particularly, to a sheet feeding mechanism for use in a machine for duplicating images on both sides of copy sheets, hereinafter sometimes referred to as "duplexing".

Duplicating machines are available for the production of copies with images formed on one side of the copy sheets. Such equipment can be reliably operated at highly satisfactory production rates. Because of the advantages of duplexing in savings of the amount of paper employed, savings in the space occupied by the copies produced, and savings in production time and equipment costs, it is desirable to provide machines for imaging both sides of a copy sheet.

Duplexing often is effected by duplicating machines employing a single printing couple to thereby provide a compact unit that may be utilized in small work areas and conserve the amount of floor space required in which to operate the equipment. However, single printing couples for duplex printing require relatively large and expensive master cylinders, blanket cylinders and impression cylinders because of the multiple images required on a single cylinder. Sometimes the cost is prohibitive. In addition, relatively complex gripper mechanisms are required on the impression cylinder, as well as complex mechanisms for handling sheets released from the impression cylinder and for re-feeding the sheets back to the gripper mechanisms on the cylinder. Such complex machines are not capable of high speed duplexing.

Consequently, it is desirable to utilize plural printing couples employing less expensive cylinders and gripper mechanisms where the work area or floor space in which the machine is to be utilized is not a premium. The plural printing couples can be arranged in tandem or straight-line configurations or in known L-shaped configurations. Regardless of the configuration or arrangement of the plural printing couples, sheet handling mechanisms are required for passing a copy sheet through a first printing couple for imaging one side of the sheet and advancing the sheet to a second printing couple for imaging the opposite side of the sheet.

One of the problems in duplexing machines utilizing plural printing couples is that the sheet handling mechanisms between the first and second printing couples must be designed to only engage the first imaged side of the copy sheets along the side edges thereof to preclude ink contamination, commonly termed "tracking". A particular sheet handling mechanism is disposed at the entrance end of the second printing couple. As with most printing couples employed in common duplicating machines, sheets are advanced seriatim to stop means where the sheets are aligned preparatory to feeding through the printing couple. Once aligned, feed rollers are intermittently operated to advance the sheets seriatim through the printing couple in unison with rotation of the various imaging cylinders. In a duplexing machine employing plural printing couples, one side of each copy sheet already has been imaged when transferred to the second printing couple. Therefore, feed roller assembies must be provided to preclude tracking the first image on one side of the sheet.

Heretofore, the feed roller assembly at the entrance to the second printing couple comprised a lower impression cylinder extending laterally across the path of and beneath the copy sheets. A pair of side feed rollers were movable toward and away from the pressure roller to intermittently feed the sheets to the second printing couple. The side feed rollers were mounted on a cylindrical shaft extending between a pair of side braces or supports. The feed rollers were adjustable axially of the shaft to accommodate different sheet sizes. However, the side braces or supports preclude the feed rollers from moving axially outwardly of the shaft beyond the braces. The braces themselves could not be moved outwardly of the shaft because of the normal confines of the machine, including its exterior frame. Therefore, sheets could not be imaged close to the extreme marginal edges thereof without the feed rollers causing tracking of the images transferred to the sheet by the first printing couple.

There is a need for a new feed roller mechanism which permits adjustment to position the side feed rollers near the marginal edges of the copy sheets. This invention is directed to solving this need by providing a new and improved sheet material feeding mechanism for duplexing machines, particularly a new feed roller assembly at the entrance end of a second printing couple in a duplex duplicating machine.

SUMMARY OF THE INVENTION

An object, therefore, of the invention is to provide a new and improved mechanism for handling copy sheets for duplexing images in a duplicating machine.

Another object of the inyention is to provide a new and improved feed roller mechanism for feeding sheets to the second printing couple of a plural printing couple duplexing machine.

In the exemplary embodiment of the invention, the sheet handling mechanism is designed for use in a duplicating machine for duplicating images on both sides of copy sheets. The duplicating machine includes a first printing couple for transferring a first image to a first side of a copy sheet and a second printing couple for transferring a second image to a second side of the sheet. Feed roller means are provided at the second printing couple for feeding the sheet in a path to the second printing couple after the first image is transferred to the sheet at the first printing couple. First roller means extend laterally across and beneath the sheet path for engaging the second, unimaged side of the sheet. Second roller means define a nip with the first roller means through which the sheet is fed. The second roller means include a pair of spaced feed rollers for engaging only the side edges of the first side of the sheet. The feed rollers are mounted on the outside of a pair of support members to permit the rollers to be positioned near the marginal edges of the sheet. The support members are adjustably secured by clamp means to a support shaft extending laterally across and above the sheet path. The clamp means are manually manipulatable to permit positioning of the feed rollers at selected positions along the support shaft to accommodate different sheet sizes.

In the preferred embodiment of the invention, the support shaft is polygonal in cross section, and the support members for the feed rollers have complementary polygonal through holes for receiving the support shaft.

The clamp means include a flat plate forming one side of each polygonal through hole for clamping engagement with one side of the polygonal support shaft. Preferably, the feed rollers are fabricated of metal to prevent ink contamination.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGURES and in which:

DETAILED DESCRIPTION OF THE PREFERRED EMBODIMENT

Figure 1:
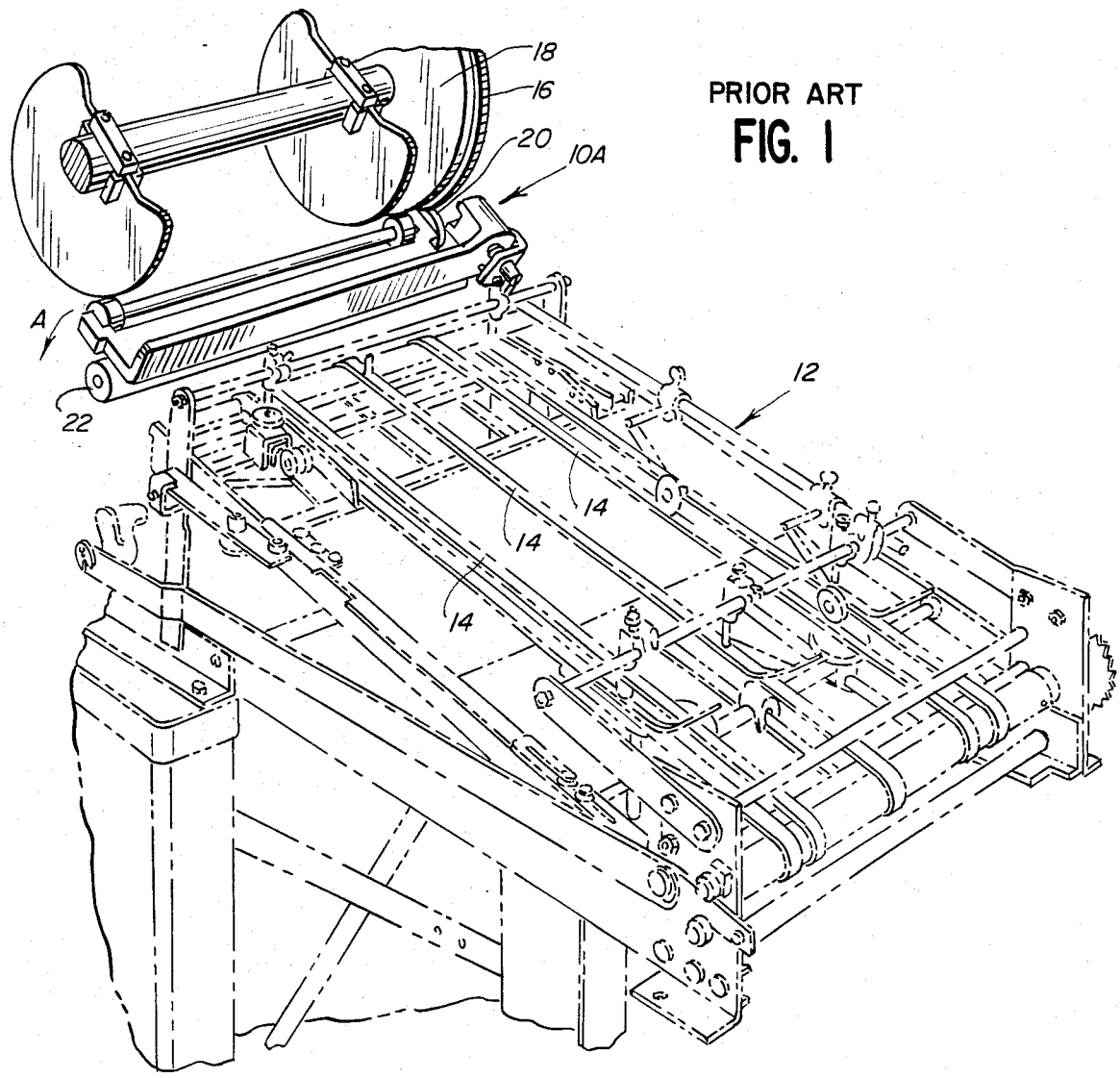
PRIOR ART FIG. 1
FIG. 1 is a fragmented perspective view of a sheet conveyor, shown in phantom, for transporting sheets to the second printing couple of a duplexing machine and illustrating the feed roller assembly of the prior art.

Referring to the drawings in greater detail, and first to FIG. 1, the invention is directed generally to a sheet material handling mechanism and particularly to a feed roller assembly, for use at the entrance end of a second printing couple in a duplex duplicating machine. A feed roller assembly, generally designated 10A, of the prior art is shown in FIG. 1 for illustrative purposes. In plural printing couple duplexing machines, a copy sheet is fed through a first printing couple (not shown) for transferring a first image to a first side of the sheet. The sheet then is inverted by known mechanisms and transported to a second printing couple where a second image is transferred to a second side of the sheet. The transport mechanism normally includes a conveyor assembly, generally designated 12 and shown in phantom in FIG. 1, including a plurality of transport belts 14. Stop means (not shown) commonly are provided for engaging and aligning the lead end of the sheet and properly registering the sheet with the second printing couple. The second printing couple includes the usual impression cylinder, blanket cylinder and master cylinder, all of which are conjointly rotated in unison by a gear train, including at least one disc gear 16. The stop means are retracted and feed roller assembly 10A is actuated to feed the sheet into the second printing couple.

Feed roller assembly 10A is actuated by a cam disc 18 which is engageable with a cam follower roller 20 on the assembly. The cam disc is effective to bias the feed roller assembly intermittently downwardly in the direction of arrow A for engagement with a stationary, driven pressure roller 22 which forms a nip through which the sheet is fed.

Figure 2:
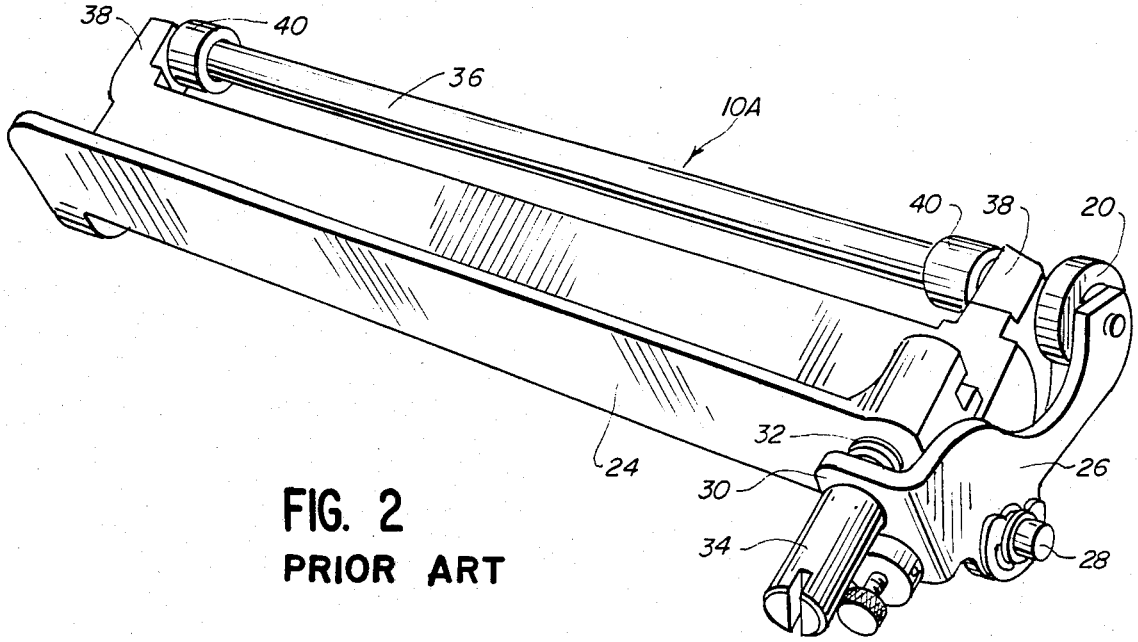
FIG. 2 PRIOR ART
FIG. 2 is a perspective view of a feed roller assembly of the prior art.

Referring to FIG. 2, feed roller assembly 10A of the prior art includes a cast frame 24 which extends laterally across and above the sheet path at the entrance to the second printing couple. Follower roller 20 is mounted on the distal end of a brace 26 for engagement with the peripheral edge of cam disc 18. Frame 24 is pivotally mounted in the machine on a pivot axle 28. Brace 26 for follower roller 20 is independently rotatable relative to axle 28. An ear portion 30 of brace 26 is sandwiched between a coil spring 32 and an adjusting screw 34 for effecting adjustment of follower roller 20 to permit adjusting the timing of the feed roller assembly, as is known.

Feed roller assembly 10A includes a cylindrical support shaft 36 rotatably mounted between a pair of support arms 38 which are formed as integral portions of frame 24. A pair of feed rollers 40 are positioned on support shaft 36 for free rotation therewith. The rollers have friction bushings on the inside thereof for engaging support shaft 36 to provide for rotation with the shaft but to permit axial adjustment of the rollers along the shaft to accommodate different sheet sizes.

Feed rollers 40 are intended for engaging copy sheets only along the side edges thereof to preclude tracking the images transferred to the sheets by the first printing couple of the duplexing machine. However, it can be seen that support arms 38, being positioned on the outside of the feed rollers at opposite ends of shaft 36, in essence, form abutment stops which preclude positioning the feed rollers at the extreme marginal edges of larger size copy sheets or copy sheets which may have images extending very close to the marginal edges of the sheet. Support arms 38 cannot be moved further outwardly without interfering with other operative components of the machine, including the precise axial disposition of follower roller 20. Therefore, the feed roller assembly of the prior art creates limitations within the machine.

Figure 3:
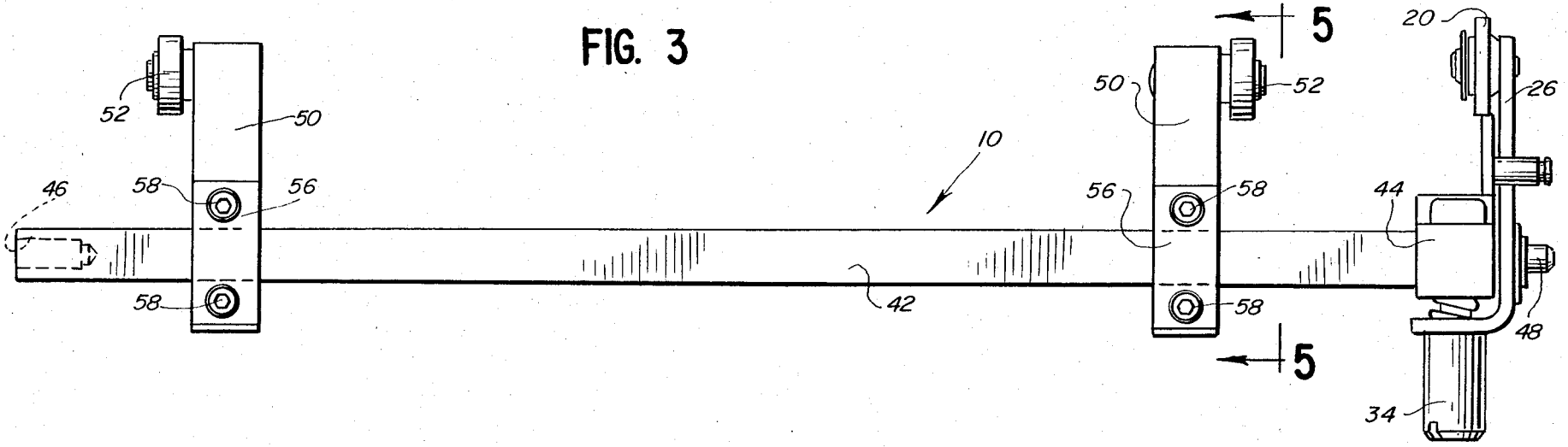
FIG. 3 is a top plan view of the feed roller assembly of the invention.
Figure 4:
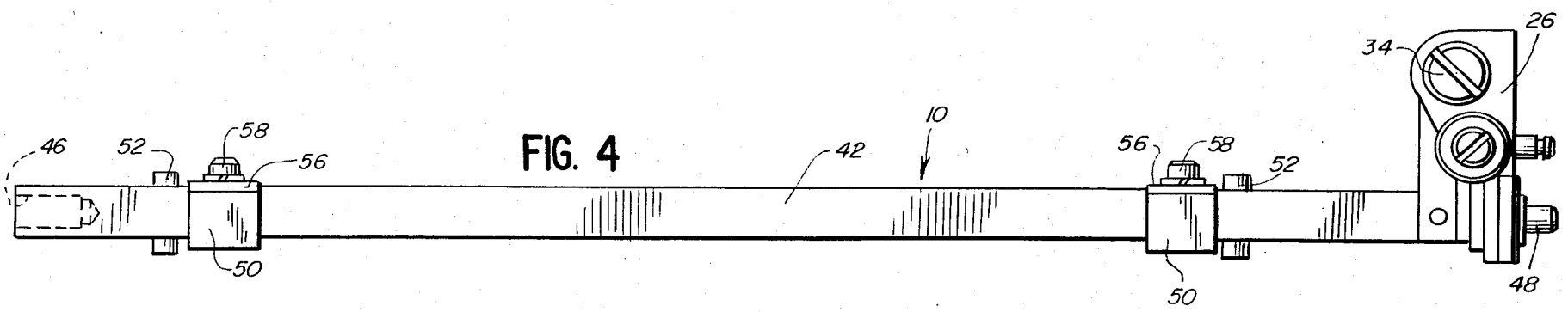
FIG. 4 is a front elevation of the feed roller assembly of FIG. 3.

Referring to FIGS. 3 and 4, feed roller assembly 10 of the invention includes a support shaft 42 which terminates at one end in a mounting block 44 for adjusting screw 34 and brace 26 for follower roller 20. The opposite end of support shaft 42 has a blind hole 46 for receiving an appropriate pivot pin on the inside of the machine frame. The opposite pivot is defined by a pin 48 projecting beyond brace 26.

A pair of support arms 50 project perpendicularly outwardly of support shaft 42 and mount a pair of feed rollers 52 for free rotation relative to the support arms. Thus, it can be seen that feed rollers 52 are rotatably mounted on the outside of support arms 50 and are not limited by other support means of the assembly, such as support arms 38 of the prior art.

Support arms 50 are mounted on support shaft 42 for axial adjustment along the shaft to selectively position feed rollers 52 for accommodating different sheet sizes.

Figure 5:
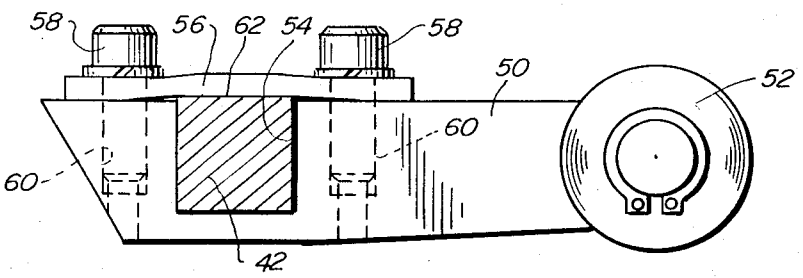
FIG. 5 is a section taken generally along line 5—5 of FIG. 3.

Referring to FIG. 5, support shaft 42 is polygonal in cross section, a square configuration as shown. Each support arm 50 has a square cut-out 54 which, in combination with a clamp plate 56, forms a through hole complementary in shape to the square configuration of support shaft 42. Clamp plate 56 is held in position by a pair of threaded fasteners 58 secured within blind holes 60 in the top of support arm 50. It can be seen in FIG. 5 that the depth of cut-out 54 in each support arm 50 is slightly less than the thickness of square shaft 42. Clamp plate 56 is thin enough to be sufficiently flexible to deform over the projecting portion of square shaft 42, as shown. This structural arrangement and deformation of clamp plate 56 accommodates any backlash between the shaft and support arms 50 without disturbing proper registration which is maintained by the support arms.

By loosening threaded fasteners 58 and, thus, clamp plate 56, support arms 50 can be adjusted axially along support shaft 42 to bring feed rollers 52 into position at and, in fact, beyond the extreme ends of the support shaft. The rollers therefore are capable of being positioned near the marginal edges of even the largest size sheet capable of being fed through the duplicating machine.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A sheet material handling mechanism for use in a duplicating machine or the like, comprising:

pressure roller means for engaging a first side of a sheet;

feed roller means for forming a nip with the pressure roller means through which the sheet is fed;

a support shaft extending generally parallel to and spaced from said pressure roller means, said support shaft being polygonal in cross section; and support means for mounting said feed roller means on said support shaft, said support means having a polygonal through hole complementary to and for receiving the support shaft, including clamp means forming one side of said polygonal through hole for clamping engagement with one side of the polygonal support shaft and a cut-out forming the other sides of the polygonal through hole, the depth of the cut-out being slightly less than the thickness of the support shaft, and said clamp plate being sufficiently flexible to deform over the support shaft when clamped thereover.

2. The sheet material handling mechanism of claim 1 wherein said support means includes a support arm projecting generally perpendicular from said support shaft for mounting said feed roller means, said cut-out being formed in said support arm.

3. The sheet material handling mechanism of claim 1, including means mounting said support means on said support shaft for axial adjustment along the support shaft to selectively position the feed roller means for accommodating different sheet sizes.

* * * * *